US008621802B2

(12) United States Patent
Spyrou

(10) Patent No.: US 8,621,802 B2
(45) Date of Patent: Jan. 7, 2014

(54) BRICK BRACKET FOR INSTALLATION OF A LEDGER ON THE BRICK FACING OR VENEER OF A STRUCTURE AND ASSOCIATED METHODS FOR THE INSTALLATION OF THE BRICK BRACKET ON THE BRICK FACING

(76) Inventor: Alexis Spyrou, Port Jefferson, NY (US)

( * ) Notice: Subject to any disclaimer, the term of this patent is extended or adjusted under 35 U.S.C. 154(b) by 275 days.

(21) Appl. No.: 12/792,358

(22) Filed: Jun. 2, 2010

(65) Prior Publication Data

US 2010/0307094 A1 Dec. 9, 2010

Related U.S. Application Data

(60) Provisional application No. 61/183,740, filed on Jun. 3, 2009.

(51) Int. Cl.
*E04B 1/38* (2006.01)
*E04B 2/30* (2006.01)

(52) U.S. Cl.
USPC ..... 52/378; 52/379; 52/489.1; 52/705; 52/712; 52/745.21; 248/216.1

(58) Field of Classification Search
USPC ..... 52/489.1, 705, 712, 713, 714, 745.21, 52/169.5, 378, 379; 248/216.1, 216.4, 248/218.3
See application file for complete search history.

(56) References Cited

U.S. PATENT DOCUMENTS

| | | | | | |
|---|---|---|---|---|---|
| 577,222 | A | * | 2/1897 | Wray | 248/220.1 |
| 625,427 | A | * | 5/1899 | Stewart, Jr. et al. | 403/190 |
| 850,662 | A | * | 4/1907 | Lorenz | 248/235 |
| 858,933 | A | * | 7/1907 | White | 52/378 |
| 1,831,565 | A | * | 11/1931 | Jagger | 52/700 |
| 1,920,520 | A | * | 8/1933 | Nord | 248/48.2 |
| 3,076,481 | A | * | 2/1963 | Wygant | 52/269 |
| 3,378,969 | A | * | 4/1968 | Larger | 52/223.7 |
| 3,450,427 | A | * | 6/1969 | Fischer | 52/513 |
| 3,487,533 | A | * | 1/1970 | Strom | 29/432 |
| 3,729,882 | A | * | 5/1973 | Allen | 52/300 |
| 3,782,058 | A | * | 1/1974 | Allen | 52/300 |
| 3,850,193 | A | * | 11/1974 | Guzzo | 137/362 |
| 3,936,986 | A | * | 2/1976 | Steel | 52/235 |
| D246,573 | S | * | 12/1977 | White | D8/384 |
| D279,315 | S | * | 6/1985 | Smith | D25/119 |
| 4,711,593 | A | * | 12/1987 | Wilhelmi | 403/187 |
| 4,765,115 | A | * | 8/1988 | Pollina | 52/712 |
| 4,837,991 | A | * | 6/1989 | Shaw | 52/98 |

(Continued)

FOREIGN PATENT DOCUMENTS

| | | | |
|---|---|---|---|
| DE | 7714716 U1 | * | 9/1977 |
| FR | 2577256 A | * | 8/1986 |
| GB | 2263918 A | * | 8/1993 |
| GB | 2292398 A | * | 2/1996 |

*Primary Examiner* — Basil Katcheves
*Assistant Examiner* — Rodney Mintz
(74) *Attorney, Agent, or Firm* — Sorell, Lenna & Schmidt, LLP

(57) ABSTRACT

A brick bracket which is installed in a recess provided by removal of brick of a brick veneer in order to be attached to studs of a framework of the building without contacting the bricks. The brick bracket has a front wall which extends outwardly and covers the brick facing and carries carriage bolts to which a ledger can be affixed such that the ledger is able to support an attached structure so that the brick bracket will not apply any force to the bricks of the brick facing.

19 Claims, 3 Drawing Sheets

(56) References Cited

U.S. PATENT DOCUMENTS

| | | | | | |
|---|---|---|---|---|---|
| 4,958,475 | A * | 9/1990 | Pollina | 52/712 |
| 5,058,358 | A * | 10/1991 | Stratton | 52/702 |
| 5,170,977 | A * | 12/1992 | McMillan | 248/300 |
| 5,501,050 | A * | 3/1996 | Ruel | 52/513 |
| 5,544,461 | A * | 8/1996 | Sommerstein | 52/235 |
| 5,548,939 | A * | 8/1996 | Carmical | 52/707 |
| 5,653,079 | A * | 8/1997 | Loeffler et al. | 52/712 |
| 5,673,529 | A * | 10/1997 | Treister et al. | 52/511 |
| 5,711,122 | A * | 1/1998 | Lee | 52/283 |
| 5,816,008 | A * | 10/1998 | Hohmann | 52/565 |
| 5,890,334 | A * | 4/1999 | Hughes, Jr. | 52/299 |
| 5,941,040 | A * | 8/1999 | McAnallen et al. | 52/586.1 |
| 6,128,883 | A * | 10/2000 | Hatzinikolas | 52/698 |
| 6,305,134 | B1 * | 10/2001 | Robinson | 52/299 |
| 6,560,943 | B1 * | 5/2003 | Leek et al. | 52/715 |
| 7,055,289 | B2 * | 6/2006 | Guth | 52/378 |
| 7,197,857 | B1 * | 4/2007 | Alvarado | 52/702 |
| 7,225,590 | B1 * | 6/2007 | diGirolamo et al. | 52/379 |
| 7,325,367 | B2 * | 2/2008 | Burgess | 52/702 |
| 7,637,070 | B2 * | 12/2009 | Hawes | 52/655.1 |
| 7,814,716 | B2 * | 10/2010 | Moffatt | 52/204.55 |
| 7,845,137 | B2 * | 12/2010 | Hohmann, Jr. | 52/714 |
| 7,849,651 | B2 * | 12/2010 | Fujito et al. | 52/506.06 |
| 7,908,804 | B2 * | 3/2011 | Vieira | 52/235 |
| 7,941,989 | B2 * | 5/2011 | Morsching | 52/800.12 |
| 8,297,024 | B2 * | 10/2012 | Hawes | 52/741.3 |
| 8,511,041 | B2 * | 8/2013 | Fransen | 52/749.13 |
| 8,516,768 | B2 * | 8/2013 | Johnson, III | 52/713 |
| 2002/0062616 | A1 * | 5/2002 | Ocampo | 52/656.9 |
| 2004/0200166 | A1 * | 10/2004 | Guth | 52/378 |
| 2006/0101760 | A1 * | 5/2006 | Cahoon | 52/459 |
| 2006/0185300 | A1 * | 8/2006 | Tremblay | 52/564 |
| 2007/0075213 | A1 * | 4/2007 | Foser et al. | 248/547 |
| 2010/0024331 | A1 * | 2/2010 | Stiffler et al. | 52/236.8 |
| 2010/0155557 | A1 * | 6/2010 | Carty | 248/231.21 |
| 2012/0167505 | A1 * | 7/2012 | Krause | 52/302.1 |
| 2012/0272606 | A1 * | 11/2012 | Gillis | 52/543 |
| 2013/0074429 | A1 * | 3/2013 | Lehtinen et al. | 52/182 |
| 2013/0118107 | A1 * | 5/2013 | Maday et al. | 52/506.05 |
| 2013/0167456 | A1 * | 7/2013 | Shapiro | 52/126.3 |

* cited by examiner

BRICK BRACKET FOR INSTALLATION OF A LEDGER ON THE BRICK FACING OR VENEER OF A STRUCTURE AND ASSOCIATED METHODS FOR THE INSTALLATION OF THE BRICK BRACKET ON THE BRICK FACING

CROSS RELATED APPLICATION

This application is a continuation of Provisional Application Ser. No. 61/183,740 filed Jun. 3, 2009 and claims the priority thereof

FIELD OF THE INVENTION

The invention relates to a bracket referred to as a brick bracket for the installation of a ledger at the surface of a brick facing or veneer of a structure such as a building.

The invention also relates to a method for the installation of such a brick bracket.

BACKGROUND

A problem exists as regards how to connect a load bearing member to a building having a brick facing or veneer. Most Building Codes specify that brick veneer can only support its own weight and cannot support additional loads, such as those from an outside structure such as a deck or roof system.

This presents a problem when it is desired to build a deck on a house with a brick veneer as it is necessary to support a ledger at the side of the house, that serves to support the joists of the deck and resists the weight of the deck. Since the ledger cannot be attached to the brick of the veneer other measures need to be taken.

Normally, the bricks must be removed in the area of the ledger and supported from above which is a difficult and expensive process.

In such case, the ledger is attached to the existing framework of the house with very long bolts of sufficient strength that can resist the bending forces induced in them as the bolts project outwardly from the framework four to five inches. Furthermore this can still lead to application of load on the bricks of the brick veneer because the bolts deflect under the load.

In the case of a deck it can be built free standing with additional girders and posts on footings. This is costly and also lacks attachment of the deck to the building.

All of these solutions create additional engineering material and labor costs and are difficult to implement.

SUMMARY OF THE INVENTION

An object of the invention is to provide means by which the deck can be connected to the framework of the building in a simple manner without the need for incident costs and labor as described above.

A further object of the invention is to provide such means by which the ledger can be attached to the framework without risk of applying forces to the brick veneer.

In accordance with the invention a bracket is provided which enables the ledger to be connected to the framework of the building without applying a load from the ledger to the bricks of the brick veneer.

In further accordance with the invention a plurality of brick brackets are installed on studs of the framework of the building, usually spaced at 16 inches. The brick brackets can be installed on each stud or on spaced studs depending on the size and weight of the deck. At each brick bracket location, three bricks are removed, namely two bricks in each row and one brick in the row thereabove. This is easily done and involves minimum labor and without any additional shoring. The brick bracket is formed with a rear wall serving as a back plate and the bracket is inserted into the recess formed by the removal of the bricks until the back wall fits flush against the respective stud for the sheathing thereon, (if any) and is fixed thereto by a plurality of lag bolts. A spanning plate extends forwardly from the back plate wall over the top surface of the next lower row of bricks by a spacing thereof so that no contact is made by the spanning plate and the bricks of the next lower row. A front wall or support plate depends from the spanning plate outside the surface of the brick veneer. The front wall supports a ledger, usually of wood. The ledger extends along the length of the brackets and is secured thereto by carriage bolts. The three bricks can be reinstalled or alternatively the space can be left open and subsequently covered by the deck joists and sealed by flags.

A feature of the invention is that the brick is rigid and made of metal in order to resist deflection.

In further accordance with the invention the bracket serves as a means to apply the load from the deck to the framework of the building without application of any force to the underlying bricks.

The method of the invention is very simple and requires no complexity in the installation of the brackets to the framing and it also assures that no bending forces will be applied to the underlying bricks of the brick veneer due to the weight of the deck and the use to which it is put.

Although the invention is described with respect to installation of a deck, the invention is also applicable to the attachment of numerous other structure or equipment.

DETAILED DESCRIPTION OF THE EMBODIMENTS OF THE INVENTION

Figure 1:
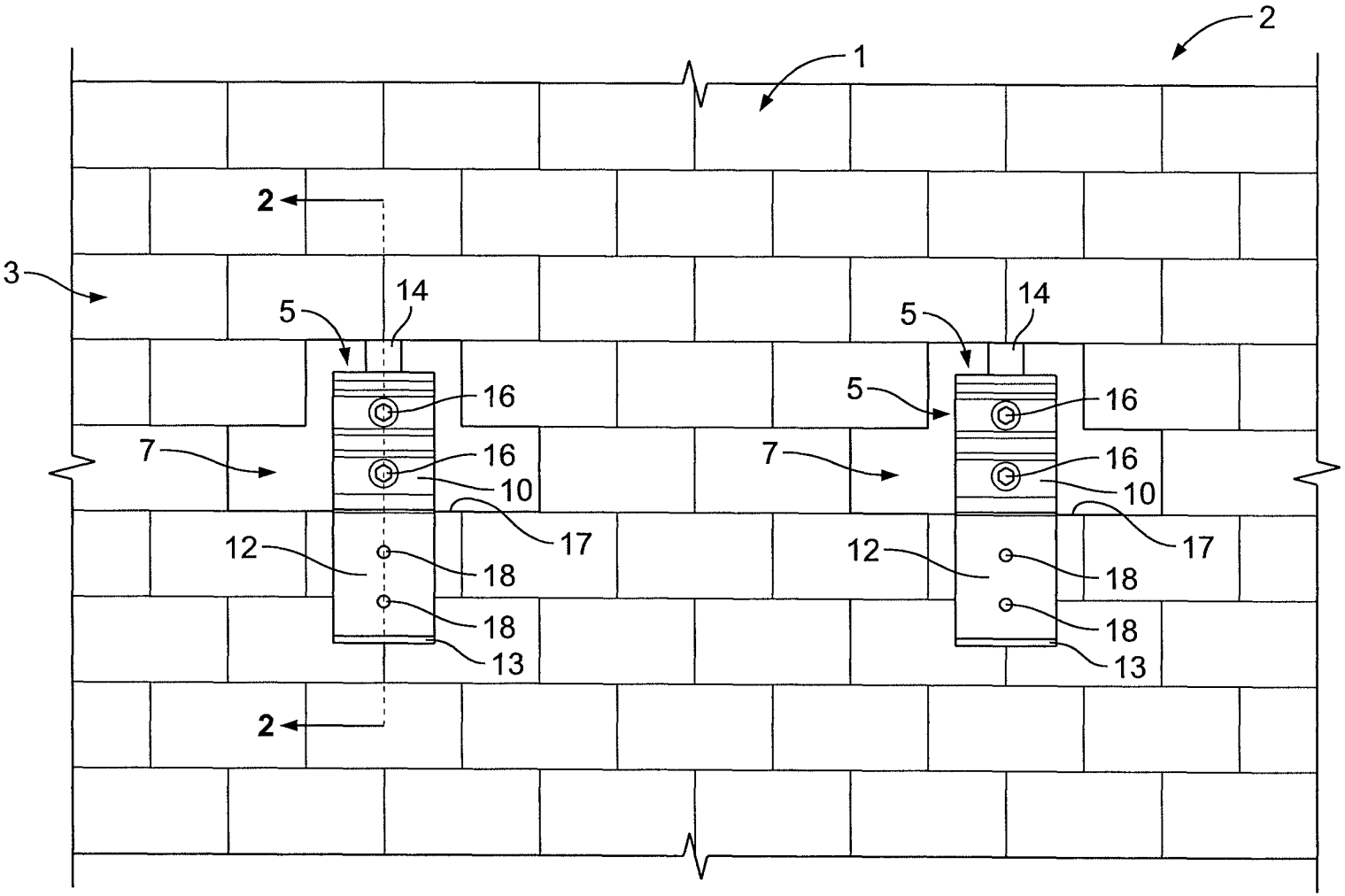
FIG. 1 is a front view of a portion of a building having a brick veneer to which is installed a brick bracket according to the invention.

FIG. 1 shows a portion of a wall 1 of a building 2 such as a house. The wall 1 has a brick facing or veneer 3 composed of rows of bricks 4 placed one above the other.

The invention is based on a construction by which a structure such as a deck (not shown) can be attached to a building. Although the invention will be described in relation to the attachment of a deck to the building it is only by way of example and other structures can be attached within the contemplation of the invention.

Since numerous Building Codes prohibit the application of load to the brick facing or veneers of the building 1 to the invention provides a unique way in which the deck can be attached to the building without imposing any load upon the brick facing. In this regard, the invention provides a plurality of brackets 5 spaced longitudinally along the line of bricks attached to the building and adapted to support the ledger 6 which extends along the length of the building over a distance corresponding to the width of the deck. The ledger 6 is intended to support the ends of joists of the deck whose opposite ends are supported at a distance from the building corresponding to the length of the deck. The manner of support of these opposite ends is not shown and is well known in the art. It should be noted that the deck can be placed at ground level or at an elevation, for example, where a door can be opened to lead to the deck. Since the brackets 5 are associated with the bricks of the brick facing they will be referred to at various times as brick brackets.

In order to attach the brackets 5 to the building 2, three bricks are removed two in one line of bricks and one in the next higher row centrally located above the two bricks in order to provide a void or recess 7 in the brick facing 3. The removal of the bricks 4 is easily carried out and requires no special skill or implements. The brick bracket 5 is then inserted within the recess 7.

The brick bracket 5 comprises a back plate or wall 10 forming an attachment wall from which a spanning plate or wall 11 extends forwardly substantially perpendicular to the back plate. At the remote end of the spanning plate 11, a front plate 12 or wall depends substantially perpendicular to the spanning plate 11 the lower end of the front plate, a ledge 13 extends substantially perpendicular thereto.

The brick bracket 5 is inserted into the recess 7 so that the back wall 10 of the brick bracket abuts against sheathing (not shown) of a stud 14 of the framing 15 of the building. Since it is intended that the brick brackets 6 are to be secured to the studs 14 the brackets are spaced along the wall of the building at intervals corresponding to the spacing of the studs 14. Normally this is 16" and the brackets can be secured at 16" spacing for relatively large and heavy decks, whereas for smaller and lighter decks the spacing can be at 32" or any other multiple of 16". The back wall 10 of each bracket extends over a height so that its top edge is spaced below the lower surface of the next higher row of bricks while its lower edge extends below the next lower row of bricks in order to fit into the space between the next lower row of bricks and the stud 14. The back wall is secured to the stud 14 by lag bolts 16 to be fixed thereto. The back wall is fixed to the stud 14 at such a height so that the spanning plate 11 extends a distance d above the top surface 17 of the fixed lower brick. The distance is generally equal to the thickness of the mortar placed between superimposed bricks. A layer of closed cell foam 19 can be introduced to fill this space and provide no transmission of force between the brick bracket and the top surface 17. By spacing the spanning plate 11 above the top surface 17 of the next lower row of bricks, transmission of any force from the spanning plate 11 and thereby of the brick brackets to the bricks is avoided.

Figure 2:
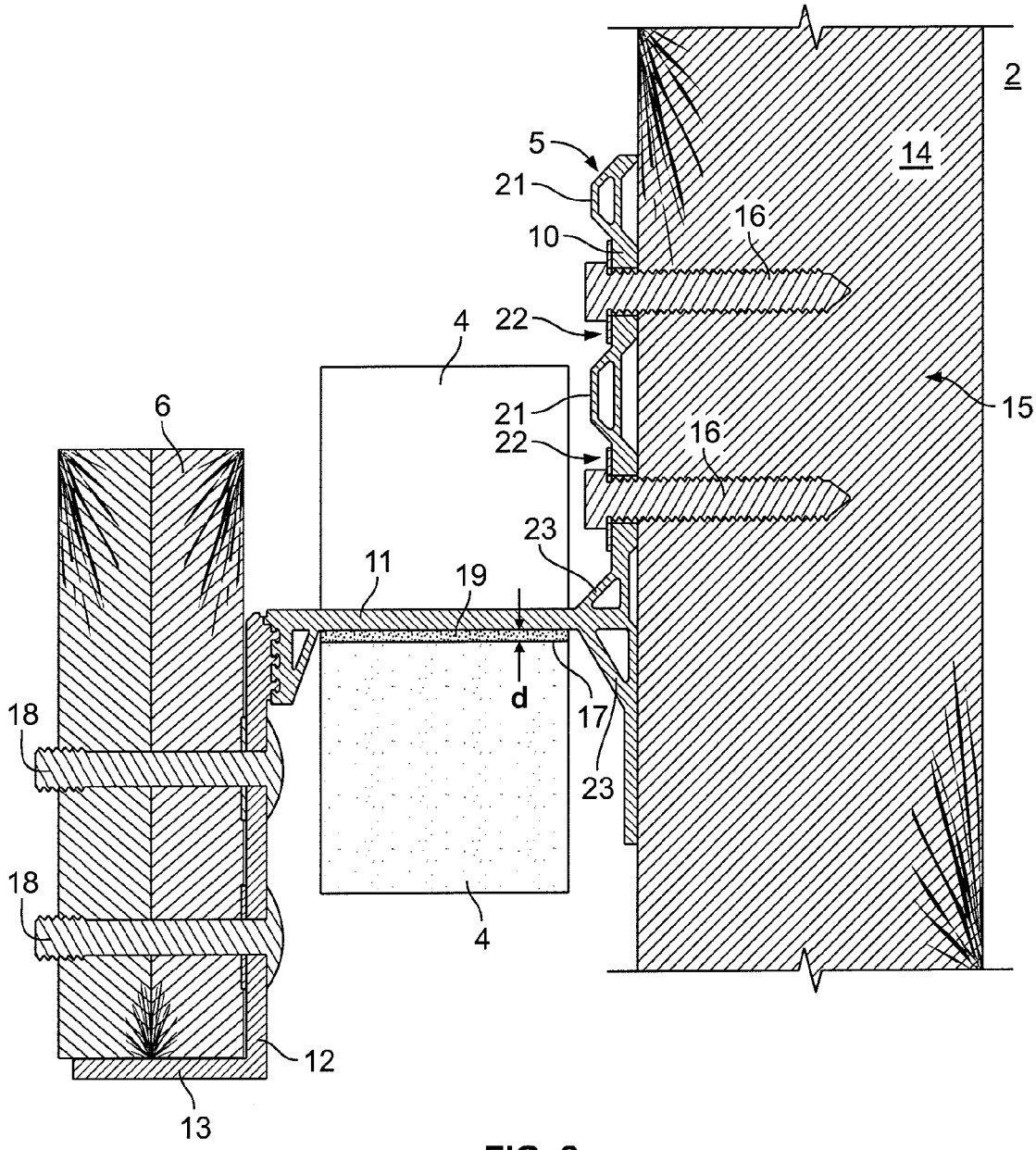
FIG. 2 is a sectional view taken along line 2-2 in FIG. 1.
Figure 3:
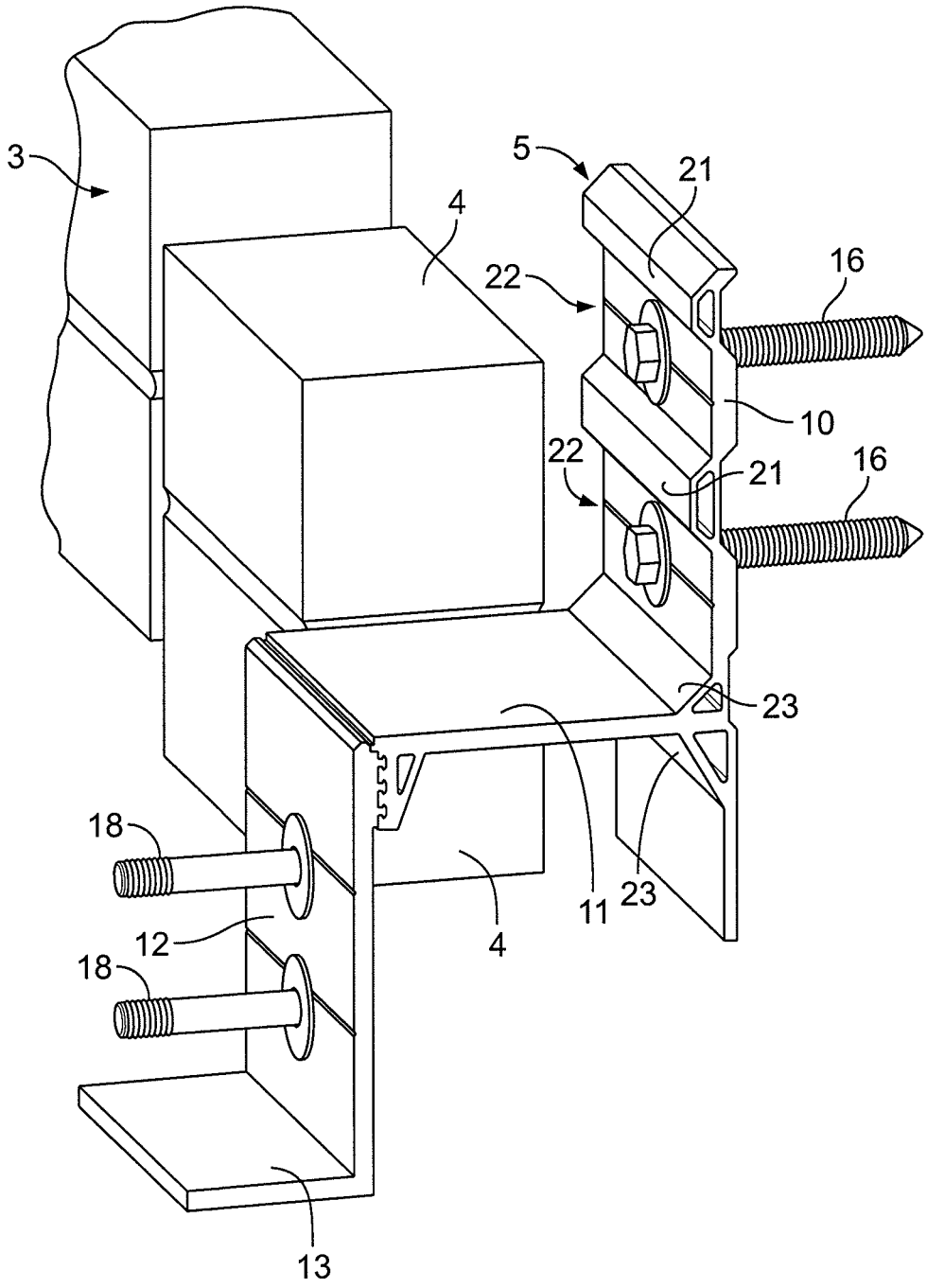
FIG. 3 is a perspective view from the front and right side of FIG. 2.

The front plate 12 extends downwardly from the spanning plate 11 over the next lower row of bricks and beyond and the ledge 13 extends forwardly from the front wall. The pair of carriage bolts 18 have been fixedly installed in the front plate and extend outwardly therefrom as shown in FIG. 2. The ledger 6 is installed on the carriage bolts and affixed thereto by nuts (not shown). The ledge can serve as a support means for the ledger in the course of its installation on the carriage bolts.

The bricks that have been removed from the brick facing can now be reinstalled in the recess 7 and mortar can be filled in the space between the adjoining bricks except for the lower surface which adjoins the upper surface 17 of the next lower row of bricks. Alternatively, the space can be left open without reinsertion of the removed bricks as the ledger will cover this space. In such case, sealing can be carried out between the ledger and the brick facing.

The ledger is of a size to accommodate the joists of the deck and in general will vary between 2×6 and 2×10. The ends of the joist rest on the top of the ledger and are secured thereto by conventional means, such as nails, bolts, and cleats.

The brick bracket is made substantially rigid to avoid bending and deflection and its thickness is a function of the size of the deck. In general the brick bracket will have a thickness between 3/16" and 3/8". The brick brackets are made of metal and in particular aluminum as these are light weight and strong.

The brick bracket 5 is preferably made as an extrusion. Specifically, in a preferred embodiment, the back wall 10 and the spanning wall 11 are made as one extrusion of T shape, and the front wall 12 and ledge 13 are made as a second extrusion of L-shape. The facing ends of walls 11 and 12 are formed with an interlocking joint, such as a tongue and groove, and are engaged and welded together to form the bracket.

The back plate 10 is formed with ridges 21 of triangular cross-section that extend thereacross to form a "washbasin-like" effect to provide strength and facilitate installation on the studs.

In order to install the lag bolts 16 and small recesses (not shown) are provided in the respective plates to facilitate such installation.

The back plate 10 is formed with projections 21 and its front face of trapezoidal cross section that extend thereacross provide strength and facilitate installation on the studs. To this effect the projections are interrupted to form recesses 22 into which the lag bolts 16 are inserted. At the lower end of plate 10 a triangular brace 23 is formed to join the back plate 10 with the spanning plate 11.

Although the invention has been described in relation to specific embodiments thereof it will become apparent to those skilled in the art that numerous modifications and variations thereof can be made without departing from the scope and spirit of the invention as defined in the attached claims.

What is claimed is:

1. A brick bracket system including a brick bracket, the brick bracket of the system comprising:

a back wall configured for attachment to a stud disposed within a building framework, wherein said back wall has a front face with projections thereon extending thereacross, the projections being interrupted to form a recess configured to receive lag bolts;

a spanning wall having a first end connected to the back wall, a second end, a top surface and a bottom surface oriented to face and spaced apart from a brick veneer to prevent a force applied to the brick bracket from being transmitted to the brick veneer of the building framework;

a front wall connected to the spanning wall and including a first surface extending along a portion of the brick veneer and a second ledge surface extending transversely from the first surface, the second ledge surface and the first surface configured to engage a ledger; and a triangular brace joining the back wall with the spanning wall and providing additional support to the brick bracket.

2. The brick bracket system as recited in claim 1, wherein the bottom surface and the brick veneer define a cavity therebetween and further comprising a closed cell foam layer disposed with the cavity.

3. The brick bracket system as claimed in claim 1, wherein said back wall has a height to fit into a space formed by removal of two bricks one above another.

4. The brick bracket system as claimed in claim 1, wherein the bracket has a width to fit into a space formed by removal of the bricks adjacent to one another.

5. The brick bracket system as claimed in claim 1, wherein said front wall has a front face and includes a ledge at a lower end extending forward thereof.

6. The brick bracket system as claimed in claim 1, formed as an extrusion.

7. The brick bracket system as claimed in claim 1, wherein said back wall, said spanning wall and said front wall form an integrated unit.

8. The brick bracket system as claimed in claim 7, wherein said integrated unit is made of metal.

9. The brick bracket system as claimed in claim 8, wherein said metal is aluminum.

10. A brick bracket system for supporting a support member from a framework of a building having brick veneer on the framework and including a brick bracket configured for fitting into a space formed between a first brick and a second brick, the brick bracket of the system including:

a back wall configured for attachment to a stud disposed within the framework, wherein said back wall has a front face with projections thereon extending thereacross, the projections being interrupted to form a recess configured to receive lag bolts;

a spanning wall configured for disposal between the first brick and the second brick and having a first end connected to the back wall and a second end, the spanning wall including a top surface and a bottom surface, the top surface configured to face the first brick and the bottom surface oriented to face and spaced apart from the second brick to prevent a force applied to the brick bracket from being transmitted to the brick veneer; and a front wall connected to the spanning wall and including a first surface and a second surface extending along a portion of the brick veneer, the second surface oriented to face and spaced apart from the second brick and a ledge surface extending transversely from the first surface, the ledge surface and the first surface configured to engage a ledger.

11. The brick bracket system as claimed in claim 10, further comprising a triangular brace joining the back wall with the spanning wall and providing additional support to the brick bracket.

12. The brick bracket system as claimed in claim 10, wherein said brick bracket is rigid and made of metal.

13. The brick bracket system as claimed in claim 10, wherein the back wall is fixed to the stud at a height such that the spanning wall extends a distance above the top of a fixed lower brick.

14. The brick bracket system as claimed in claim 10, in which a plurality of brick brackets are arranged in spaced relation along a row of bricks of the brick veneer and are secured to the framework.

15. An assembly of a plurality of brick brackets as claimed in claim 10, wherein the brick brackets are arranged in a longitudinal array in spaced relation to support the support member.

16. The assembly of a plurality of brick brackets as claimed in claim 15, wherein the support member is connected by bolts to the front wall of respective brick brackets.

17. A method for securing a support member to framework of a building using brick brackets, comprising:

using brick brackets as claimed in claim 10, removing a plurality of bricks of the brick veneer at spaced intervals along a longitudinal line of bricks of the veneer, inserting the respective brick bracket in an opening formed by removal of the bricks of the veneer, securing the back walls of the brick brackets to the framework so that the spanning walls of the brick brackets are spaced from tops of a next lower row of bricks of the brick veneer, and securing the support member to the front walls of the brick brackets.

18. The method of claim 17, wherein the support member is secured to the front wall by bolts, said brick brackets being secured to the framework by bolts connecting the back wall of the brick brackets to the framework.

19. The method of claim 18, wherein said bolts cause said support member to be applied flush against the front walls of the brick brackets.

* * * * *